US011845634B2

(12) United States Patent
Sotoca et al.

(10) Patent No.: US 11,845,634 B2
(45) Date of Patent: Dec. 19, 2023

(54) SAFETY BRAKE DEVICE

(71) Applicant: Otis Elevator Company, Farmington, CT (US)

(72) Inventors: Javier Munoz Sotoca, Madrid (ES); Ruben Marante-Chasco, Madrid (ES)

(73) Assignee: OTIS ELEVATOR COMPANY, Farmington, CT (US)

( * ) Notice: Subject to any disclaimer, the term of this patent is extended or adjusted under 35 U.S.C. 154(b) by 119 days.

(21) Appl. No.: 17/388,201

(22) Filed: Jul. 29, 2021

(65) Prior Publication Data

US 2022/0106164 A1 Apr. 7, 2022

(30) Foreign Application Priority Data

Oct. 7, 2020 (EP) ..... 20382884

(51) Int. Cl.
*B66B 5/22* (2006.01)

(52) U.S. Cl.
CPC ..... *B66B 5/22* (2013.01)

(58) Field of Classification Search
CPC ..... B66B 5/20; B66B 5/22; B66B 5/06
See application file for complete search history.

(56) References Cited

U.S. PATENT DOCUMENTS

| | | | | |
|---|---|---|---|---|
| 11,066,274 | B2 * | 7/2021 | Khzouz | B66B 5/18 |
| 2015/0240894 | A1 | 8/2015 | Piech et al. | |
| 2019/0144240 | A1 | 5/2019 | Steinhauer et al. | |

FOREIGN PATENT DOCUMENTS

| | | | | |
|---|---|---|---|---|
| DE | 102013111385 | A1 * | 4/2015 | B66B 5/18 |
| EP | 3677534 | A1 * | 7/2020 | B66B 1/3423 |
| WO | WO-2005044709 | A1 * | 5/2005 | B66B 5/02 |
| WO | 2017087978 | A1 | 5/2017 | |
| WO | WO-2017098299 | A1 * | 6/2017 | B66B 5/044 |

OTHER PUBLICATIONS

European Search Report for Application No. 20382884.3; dated Mar. 18, 2021; 9 Pages.

* cited by examiner

*Primary Examiner* — Diem M Tran
(74) *Attorney, Agent, or Firm* — CANTOR COLBURN LLP

(57) ABSTRACT

A safety brake device, for use in a conveyance system including a guide rail and a component moveable along the guide rail, comprises a safety brake moveable between a non-braking position where the safety brake is not in engagement with the guide rail and a braking position where the safety brake is engaged with the guide rail. The safety brake device also comprises an actuator for the safety brake, and the actuator comprises a mounting portion for mounting the actuator to the component, a pad arranged to be moveable relative to the mounting portion between a first position spaced from the guide rail and a second position in contact with the guide rail, and at least one biasing member configured to apply a biasing force to move the pad from the first position to the second position.

14 Claims, 15 Drawing Sheets

SAFETY BRAKE DEVICE

FOREIGN PRIORITY

This application claims priority to European Patent Application No. 20382884.3, filed Oct. 7, 2020, and all the benefits accruing therefrom under 35 U.S.C. § 119, the contents of which in its entirety are herein incorporated by reference.

TECHNICAL FIELD

This disclosure relates to a safety brake device for use within a conveyance system such as an elevator system, and to a method of operating a safety brake in a safety brake device.

BACKGROUND

Many elevator systems include a hoisted elevator car, a counterweight, a tension member which connects the hoisted elevator car and the counterweight, and a sheave that contacts the tension member. During operation of such an elevator system, the sheave may be driven by a machine to move the elevator car and the counterweight through the hoistway, with their movement being guided by guide rails. Typically a governor is used to monitor the speed of the elevator car. According to standard safety regulations, such elevator systems must include an emergency braking device (known as a safety brake or "safety gear") which is capable of stopping the elevator car from moving downwards, even if the tension member breaks, by gripping a guide rail.

The risks associated with freefall of an elevator car in an elevator system are particularly acute for elevator systems employed in high-rise buildings, where more significant over speed may occur due to the increased drop. The actuation of the safety brake is usually mechanically controlled. An elevator system employing a mechanical governor and mechanically-actuated safety brake is shown in FIG. 1, and described in greater detail below.

Electromechanical actuators have also been proposed, wherein a safety controller is in electrical communication with an electromagnetic component that can be controlled to effect movement of the safety brake via a mechanical linkage. It is an aim of the present disclosure to provide an improved safety brake device.

SUMMARY

According to a first aspect of this disclosure there is provided a safety brake device for use in a conveyance system including a guide rail and a component moveable along the guide rail, the safety brake device comprising: a safety brake moveable between a non-braking position where the safety brake is not in engagement with the guide rail and a braking position where the safety brake is engaged with the guide rail; an actuator for the safety brake, the actuator comprising: a mounting portion for mounting the actuator to the component, a pad arranged to be moveable relative to the mounting portion between a first position spaced from the guide rail and a second position in contact with the guide rail, and at least one biasing member configured to apply a biasing force to move the pad from the first position to the second position; and a linkage mechanism coupled between the safety brake and the actuator such that, when the mounting portion is moving downwards relative to the guide rail, movement of the pad to the second position creates an upwards reaction force transmitted by the linkage mechanism to move the safety brake into the braking position; wherein the pad comprises a ferromagnetic material and the actuator further comprises an electromagnet operable to apply a magnetic field to the pad and thereby create a magnetic force acting against the biasing force to move the pad towards the first position.

Thus it will be appreciated by those skilled in the art that, if the electromagnet is turned off, for example if the component is detected to be moving too fast or accelerating at too great a rate, then the pad will move from the first position to the second position under the biasing force. The pad will therefore contact the guide rail, and due to the relative downwards motion of the mounting portion fixed to the component compared to the pad in contact with the guide rail, an upwards reaction force will be created and transmitted by the linkage mechanism to the safety brake, thereby moving the safety brake into the braking position to engage with the guide rail and stop motion of the component. It will be understood by the skilled person that the contact between the pad in the second position and the guide rail results in a frictional force between the pad and the guide rail, but this frictional force alone is not strong enough to cease motion of the component relative to the guide rail. In the second position, the pad has moved laterally to contact the guide rail but there may still be a degree of relative movement between them. It is the engagement of the safety brake with the guide rail that creates a much larger frictional force to bring the component to a stop. When the safety brake is in the non-braking position, the safety brake is spaced from the guide rail or in minimal contact so there is not an engagement functioning to achieve a frictional braking force that can stop the component. When the safety brake is in the braking position, the safety brake is brought into intentional hard contact with the guide rail to create an engagement functioning to achieve a frictional braking force sufficient to stop the component.

The disclosed safety brake device may require fewer components than prior art mechanical safety brake devices which may therefore reduce the space required by the safety brake device. In addition, the reduction in the number of components may reduce the cost on installation and service. As the safety brake and actuator are combined into a single device instead of being installed onto the component as two separate systems, this may further reduce cost. Further to this, the safety brake device set out in the present disclosure may have more modularity regarding the type of conveyance system it is to be used in. For example, the number of biasing members may be increased, or the force provided by the at least one biasing member may be altered.

The pad may have a high friction surface. This high friction surface may be the surface of the pad which contacts the guide rail when the pad is in the second position. For example, the high friction surface may be knurled or roughened.

It will be understood by the skilled person that the pad therefore provides two functions: the friction between the pad and the guide rail results in the upwards reaction force transmitted to the linkage mechanism and, as the pad is ferromagnetic, it can be arranged to complete the magnetic circuit of the electromagnet when in the first position. The electromagnet may be composed of an iron core which is surrounded by a coil of wire. When current flows through the coil, a magnetic field is generated by the electromagnet. The electromagnet may have a G-shaped or E-shaped iron core, or any other shape which is suitable.

In a set of examples, the pad is non-magnetic. It will be understood that the moveable pad being non-magnetic means that it does not include any permanent magnet. Hence the pad is not itself magnetically attracted to a ferrous guide rail. The inclusion of ferromagnetic material allows the non-magnetic pad to be magnetised in the presence of the magnetic field applied by the electromagnet, but the magnetic force pulls the pad towards the electromagnet and holds it in the first position against the biasing force. When the electromagnetic is turned off, the non-magnetic pad is no longer magnetised and the only force pushing the pad into contact with the guide rail is the biasing force i.e. no magnetic force. The absence of a permanent magnet can make the safety brake device smaller, cheaper and easier to adapt to different conveyance systems.

In various examples, the pad may include any ferromagnetic material such as iron, cobalt, nickel, or an alloy of any of these metals. In examples where the pad is non-magnetic, the pad may be fabricated from any ferromagnetic material such as iron, cobalt, nickel, or an alloy of any of these metals. In at least some examples the non-magnetic pad is made wholly from a ferromagnetic material.

In a set of examples, the electromagnet comprises an electrical coil and a ferromagnetic core, and the pad includes a reset portion that is arranged in the first position to form part of the ferromagnetic core. This arrangement enables the pad to complete the magnetic circuit of the electromagnet, thus assisting reset when the pad is re-aligned with the electromagnet such that it moves more easily from the second position back to the first position.

In a set of examples, the electromagnet is fixed relative to the mounting portion. The linkage mechanism may be connected to the pad or to the support. In this set of examples, therefore, when the electromagnet is turned off and the pad moves from the first position to the second position, the electromagnet stays fixed in its position within the safety brake device whilst the support, biasing member and pad move upwards relative to the fixed electromagnet and mounting portion. The linkage mechanism may therefore be either connected to the pad or support, as both the pad and support will move upwards relative to the mounting portion and therefore move the linkage mechanism to engage the safety brake.

In a set of examples, the pad is connected to a support which is movable upwards relative to the mounting portion in response to the upwards reaction force. In a set of examples, the safety brake device further comprises a bearing surface arranged between the support and the mounting portion which enables upwards movement of the support relative to the mounting portion. This surface may comprise, for example, linear roller bearings along which the support and therefore pad can move relative to the mounting portion. Alternatively, the surface may be any low friction surface which enables the support to move relative to the mounting portion.

In a set of examples, at least one guiding rod is arranged to connect the pad to the support so as to guide lateral movement of the pad from the first position to the second position relative to the support. In a set of examples, the at least one biasing member is connected to the support and to the pad. This arrangement enables the at least one biasing member to provide the biasing force to the pad which moves it from the first position to the second position in contact with the guide rail. The biasing member may be a spring or any other resilient member which can be configured to provide the biasing force to move the pad from the first position to the second position. More than one spring may be used, for example two springs may be used and connected at either end of the pad and support. The springs may be pre-compressed between the support and pad such that they provide a biasing force to the pad. The guiding rod is rigid and may therefore prevent the pad from falling due to gravity by providing a connection to the support. In a set of examples, the at least one guiding rod is arranged to guide the at least one biasing member. A guiding rod may be arranged to pass through the centre of a coil spring. The guiding rod may therefore act to prevent the spring from buckling by supporting the weight of the pad. The guiding rod may be connected to the support and pad with nuts.

In another set of examples, the electromagnet is connected to the support so as to be moveable relative to the mounting portion. In a set of examples, the linkage mechanism is connected to the electromagnet, to the pad, or to the support. Therefore, in this set of examples, when the electromagnet is turned off and the pad moves from the first to the second position, the electromagnet moves with the support, biasing member and pad upwards relative to the mounting portion. The linkage mechanism may therefore be either connected to the pad, electromagnet or support, as the pad, electromagnet and support will move upwards relative to the mounting portion and move the linkage mechanism to engage the safety brake.

In a set of examples, the electromagnet is connected to the support, and the at least one biasing member is connected to the support and to the pad, in a symmetrical arrangement such that the biasing force applied to move the pad from the first position to the second position is opposed by the magnetic force without applying a torque to the pad. This arrangement helps reduce any torque acting on the pad as the biasing member(s) may be arranged symmetrically about the electromagnet such that the biasing forces and magnetic force acting on the pad acted through the centre of the pad, preventing any rotation.

In a set of examples, the safety brake device further comprises a controller electrically connected to the electromagnet to selectively reduce or disconnect an electrical power supply to the electromagnet in an emergency stop situation. The safety brake device may be used in a conveyance system such as an elevator system comprising a speed sensor which monitors the speed of the component (e.g. elevator car). If a freefall, over-speed condition, or over-acceleration condition of the component is detected by the speed sensor, the controller will operate to reduce or remove power to the electromagnet. The controller may be in direct communication with such a speed sensor or accelerometer, or signals from the speed sensor and/or accelerometer may be monitored by a separate safety controller that then decides when to control an electrical power supply to the electromagnet. The electromagnet will therefore not produce a magnetic field to counteract the biasing force, and the pad will therefore move from the first to the second position, and the safety brake will therefore be engaged if the elevator is moving or accelerating too fast. The electromagnet may therefore be controlled in an emergency stop mode.

In a set of examples, the safety brake device is reset by moving the component upwards relative to the guide rail. The component is moved upwards such that the safety brake is disengaged and the electromagnet is aligned with the pad. Once aligned, power is restored to the electromagnet by the controller, creating an attractive magnetic force between the electromagnet and pad. This magnetic force is stronger than the biasing force caused by the biasing member, and the pad is therefore pulled away from the guide rail to the first position such that the safety brake device is reset.

In a set of examples, the support comprises a surface arranged to move upwards and downwards relative to the mounting portion, the surface oriented at an acute angle relative to a direction of lateral movement of the pad between the first position and the second position. This arrangement may allow the actuator to "self-reset". As the surface is at an angle relative to the pad, the support may therefore be wedge shaped in order to provide a vertical support surface on which to connect the springs and guiding rods. To engage the safety brake, the controller will reduce or remove power to the electromagnet such that the biasing force provided by the biasing member pushes the pad to the second position, in contact with the guide rail. Due to the relative downwards motion of the component, the support, biasing member and pad will move upwards, with the support moving along the angled surface. Due to this angle of the surface, the biasing member will be compressed as it moves relatively upwards with the pad. The linkage mechanism will transmit this upwards reaction force to the safety brake, such that the safety brake is engaged.

The system is able to automatically self-reset due to the angled support surface. Once the safety brake is engaged, the component will be brought to a stop and there is no longer any upwards reaction force on the pad. Due to the angled support surface, the electromagnet will displace towards the pad as the electromagnet moves upwards. Therefore, there may be little or no gap between the electromagnet and pad in the second position such that a minimal electrical current may be sufficient for the magnetic force provided by the electromagnet to overcome the biasing force provided by the biasing member, assisting with reset of the actuator.

The safety brake may be mounted to the component independently of the actuator, with the linkage mechanism arranged between them. However, in a set of examples, the mounting portion also mounts the safety brake to the component such that the safety brake device is a single integrated unit. This arrangement is advantageous as the safety brake device is one unit which may be affixed to a component in a single installation step.

In a set of examples, the safety brake comprises a wedge brake. Some suitable wedge brake arrangements include a roller mounted to move relative to a wedge, or one or more wedge-shaped brake pads mounted to move into engagement with a guide rail. Therefore, movement of the linkage mechanism coupled between the wedge brake and the actuator is such that when the mounting portion is moving downwards relative to the guide rail, movement of the pad to the second position creates an upwards reaction force transmitted by the linkage mechanism to move the wedge brake upwards into the braking position. The wedge brake will be moved against the guide rail and the friction between these two surfaces will bring the component to a halt. However, the safety brake may comprise any suitable arrangement for stopping motion of a component via mechanical engagement with a guide rail.

In examples of the present disclosure, the safety brake device may find use in a variety of conveyance systems, such as elevator systems, people conveyors, goods transporters, etc. The component that is moveable along a guide rail may be a platform, a counterweight or a cab for transporting goods or people. In some examples, the conveyance system is an elevator system and the component is an elevator car.

According to some further examples of the present disclosure, there is provided an elevator system comprising an elevator car driven to move along at least one guide rail, and the safety brake device as set out previously, wherein the mounting portion is mounted to the elevator car and the safety brake is arranged to be moveable between the non-braking position where the safety brake is not in engagement with the guide rail and the braking position where the safety brake is engaged with the guide rail. In such examples, the safety brake may be mounted to the elevator car independently of the actuator, or via the mounting portion.

In a set of examples, the elevator system comprises a speed sensor and a safety controller arranged to receive a speed signal from the speed sensor and to selectively reduce or disconnect an electrical power supply to the electromagnet upon detecting an overspeed or over-acceleration condition for the elevator car based on the speed signal. It will be appreciated that acceleration may be determined through processing of the speed signal to produce an acceleration signal e.g. by differentiating the speed signal. In a set of examples, in addition or alternatively, the elevator system comprises an accelerometer, with the safety controller arranged to receive an acceleration signal from the accelerometer, and selectively reduce or disconnect an electrical power supply to the electromagnet upon detecting an over-acceleration condition for the elevator car. Therefore, when the elevator car is travelling at overspeed or over-acceleration, reduction of the power to the electromagnet will reduce the magnetic force applied to the pad. The biasing force will therefore move the pad from the first to the second position, and the safety brake will therefore be actuated to engage with the guide rail, preventing further motion of the elevator car.

According to a second aspect of the present disclosure, there is provided a method of operating a safety brake in a safety brake device, the safety brake moveable between a non-braking position where the safety brake is not in engagement with a guide rail and a braking position where the safety brake is engaged with a guide rail, the safety brake device comprising: an actuator comprising: a mounting portion for mounting the actuator to a component moveable along a guide rail; a pad arranged to be moveable relative to the mounting portion between a first position spaced from the guide rail and a second position in contact with the guide rail, the pad comprising a ferromagnetic material; at least one biasing member configured to apply a biasing force to move the pad from the first position to the second position; and an electromagnet; and a linkage mechanism coupled between the safety brake and the actuator; the method comprising: operating the electromagnet in a normal mode to apply a magnetic field to the pad and thereby create a magnetic force acting against the biasing force to move the pad towards the first position; and operating the electromagnet in an emergency stop mode to reduce or remove the magnetic force acting against the biasing force such that the pad moves to the second position to create an upwards reaction force when the mounting portion is moving downwards relative to the guide rail, the upwards reaction force being transmitted by the linkage mechanism to move the safety brake into the braking position.

In a set of examples, the method further comprises: detecting an overspeed or over-acceleration of the component; and initiating the emergency stop mode by selectively reducing or disconnecting an electrical power supply to the electromagnet.

As mentioned above, such methods may find use in a variety of conveyance systems, but in at least some examples the method is used to operate a safety brake in a safety brake device in an elevator system and the component is an elevator car.

DETAILED DESCRIPTION

Figure 1:
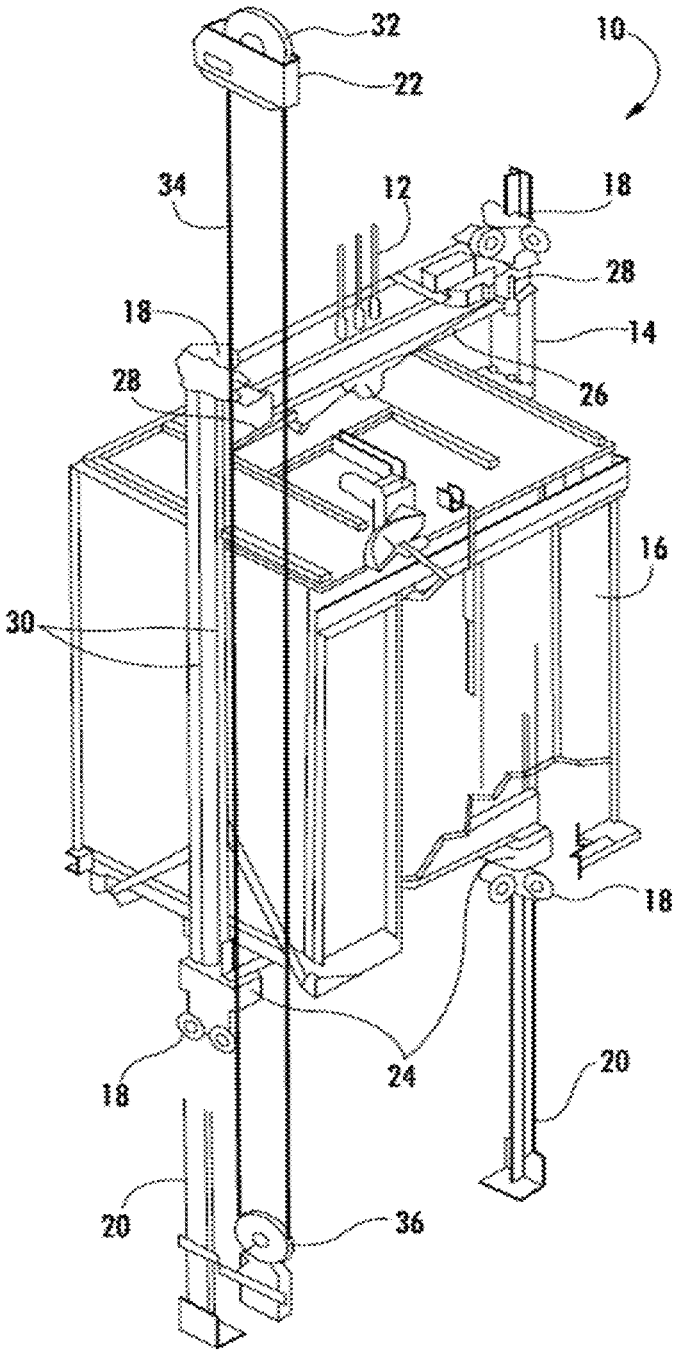
FIG. 1 is a schematic diagram of an elevator system employing a mechanical governor.

FIG. 1 shows an elevator system, generally indicated at 10. The elevator system 10 includes cables or belts 12, a car frame 14, an elevator car 16, roller guides 18, guide rails 20, a governor 22, and a pair of safety brakes 24 mounted on the elevator car 16. The governor 22 is mechanically coupled to actuate the safety brakes 24 by linkages 26, levers 28, and lift rods 30. Governor 22 includes a governor sheave 32, rope loop 34, and a tensioning sheave 36. Cables 12 are connected to car frame 14 and a counterweight (not shown in FIG. 1) inside a hoistway. Elevator car 16, which is attached to car frame 14, moves up and down the hoistway by force transmitted through cables or belts 12 to car frame 14 by an elevator drive (not shown) commonly located in a machine room at the top of the hoistway. Roller guides 18 are attached to car frame 14 to guide the elevator car 16 up and down the hoistway along the guide rails 20. Governor sheave 32 is mounted at an upper end of the hoistway. Rope loop 34 is wrapped partially around governor sheave 32 and partially around tensioning sheave 36 (located in this example at a bottom end of the hoistway). Rope loop 34 is also connected to elevator car 16 at lever 28, ensuring that the angular velocity of governor sheave 32 is directly related to the speed of elevator car 16.

In the elevator system 10 shown in FIG. 1, the governor 22, a machine brake (not shown) located in the machine room, and the safety brakes 24 act to stop the elevator car 16 if it exceeds a set speed as it travels inside the hoistway. If elevator car 16 reaches an over-speed or over-acceleration condition, the governor 22 is triggered initially to engage a switch, which in turn cuts power to the elevator drive and drops the machine brake to arrest movement of the drive sheave (not shown) and thereby arrest movement of elevator car 16. If, however, the elevator car 16 continues to experience an over speed condition, governor 22 may then act to trigger the safety brakes 24 to arrest movement of elevator car 16. In addition to engaging a switch to drop the machine brake, governor 22 also releases a clutching device that grips the governor rope 34. Governor rope 34 is connected to the safety brakes 24 through mechanical linkages 26, levers 28, and lift rods 30. As elevator car 16 continues its descent, governor rope 34, which is now prevented from moving by actuated governor 22, pulls on the operating levers 28. The operating levers 28 actuate the safety brakes 24 by moving linkages 26 connected to lift rods 30, which lift rods 30 cause the safety brakes 24 to engage the guide rails 20 to bring the elevator car 16 to a stop.

Mechanical speed governor systems are being replaced in some elevators by electronically-actuated systems. A safety brake device 40 is described herein that is suitable for electronic or electrical control of actuating and resetting the safety brakes 24.

Figure 2:
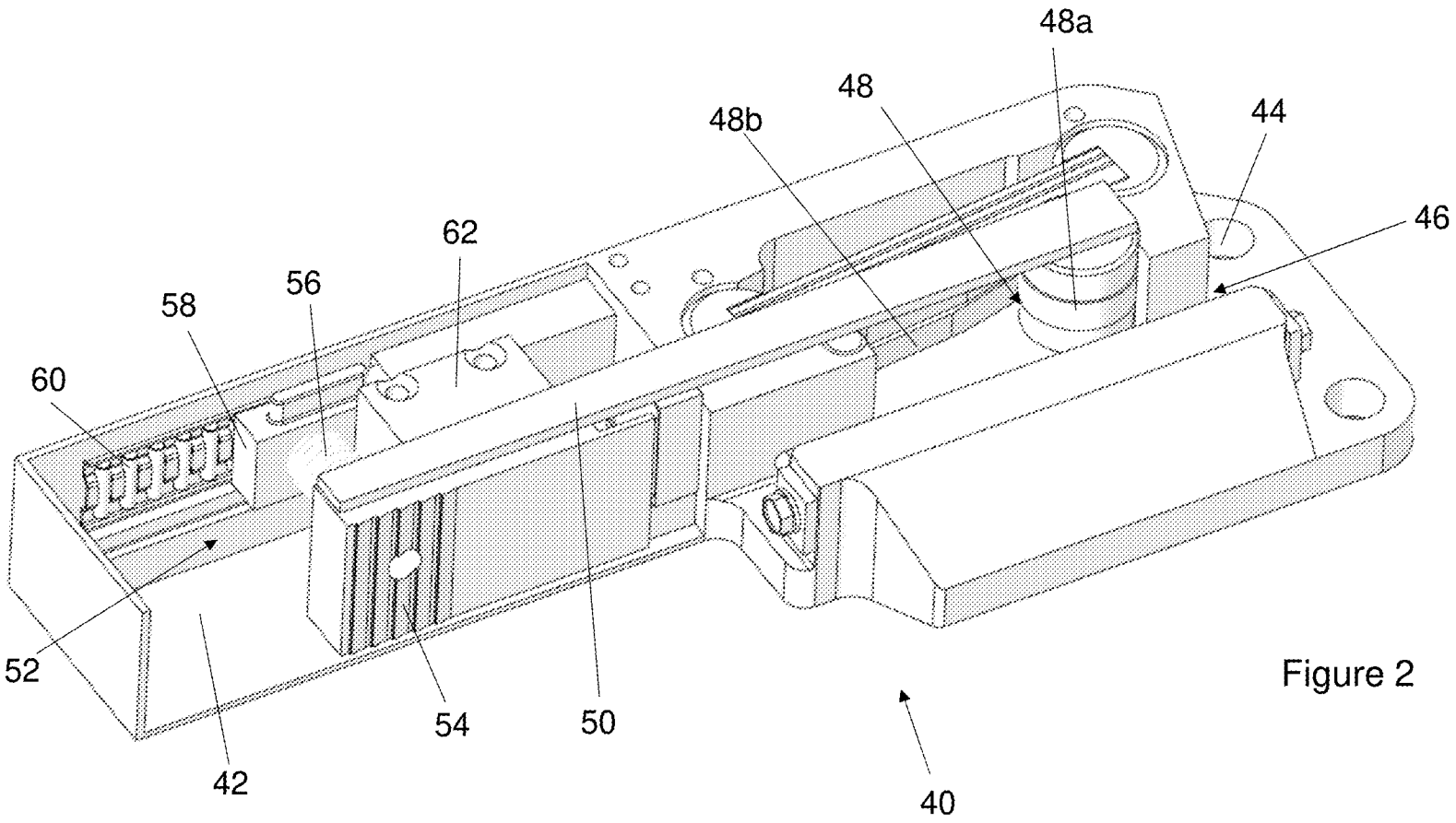
FIG. 2 is a perspective view of a safety brake device according to an example of the present disclosure.

FIG. 2 shows an example of a safety brake device 40 which can be mounted onto the elevator car 16 of FIG. 1 to actuate the safety brake 48 without relying on a mechanical coupling to the governor 22. The safety brake device 40 includes a mounting portion 42 which may be mounted on the external surface of the elevator car 16. The mounting portion 42 includes apertures 44 which enable fixation of the mounting portion 42 to the elevator car frame 14 (as seen in FIG. 1). The safety brake device 40 further comprises a channel 46 which extends along the length of the safety brake device 40 and is configured to accommodate one of the guide rails 20 (not shown).

The safety brake device 40 comprises a safety brake 48 which is moveable between a non-braking position where the safety brake 48 is not in engagement with the guide rail 20, and a braking position where the safety brake 48 is engaged with the guide rail 20. The safety brake 48 is illustrated as a wedge-type safety brake comprising an angled "wedge" surface 48*b* and a roller 48*a* moveable along the surface 48*b* from a non-braking position (as seen in FIG. 2) to a braking position where the roller 48*a* is brought into engagement with the guide rail 20. Such wedge-type safety brakes are well-known in the art, for example as seen in U.S. Pat. No. 4,538,706. However, it will be appreciated that the safety brake 48 may take any suitable form and could instead comprise a wedge-shaped brake pad instead of the roller, or a magnetic brake pad.

Regardless of the exact form of the safety brake 24, a linkage mechanism 50 is coupled between the safety brake 48 and an actuator 52. The actuator 52 comprises the mounting portion 42, and a pad 54, a spring 56, a support 58, a set of linear roller bearings 60, and an electromagnet 62. The pad 54 is movable between a first position spaced from the guide rail 20 (as seen in FIG. 2) and a second position in contact with the guide rail 20. The spring 56 is coupled at one end to the pad 54 and is configured to apply a biasing force to move the pad 54 from the first position to the second position. The spring 56 is coupled at its other end to the support 58. The support 58 is in contact with the linear roller bearings 60 such that the support 58, spring 56, and pad 54 are moveable linearly relative to the mounting portion 42. In this example, the electromagnet 62 is fixed in position relative to the mounting portion 42 and is arranged to apply a magnetic force to the hold the pad 54 in the first position. The magnetic force therefore opposes and overcomes the biasing force of the spring 56.

Figure 3B:
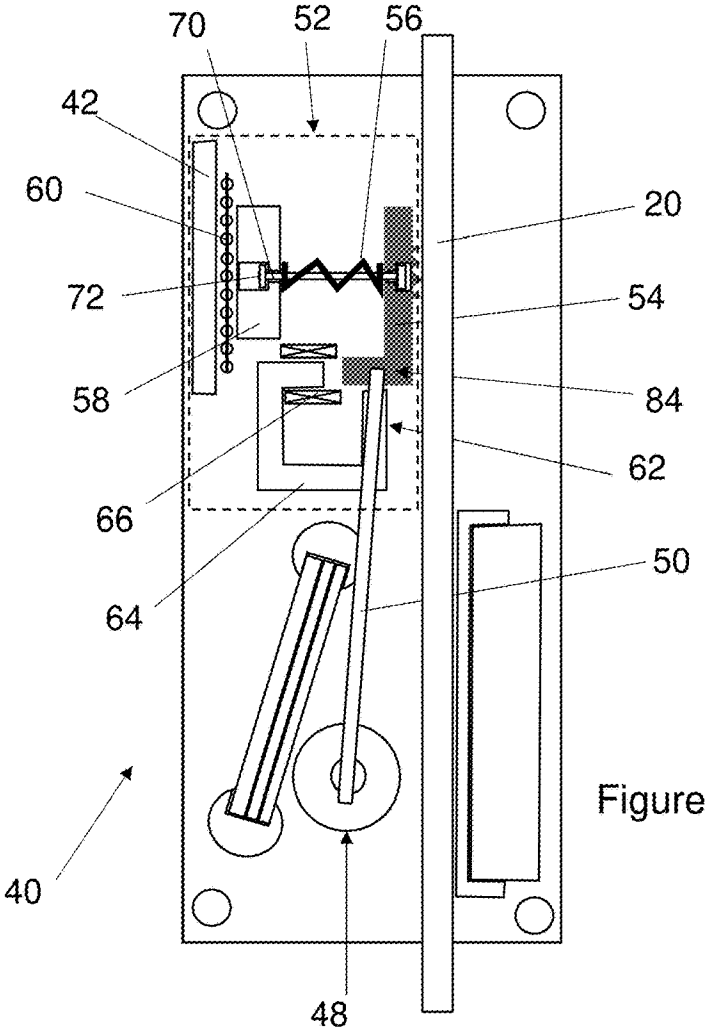
FIG. 3B is a schematic cross-sectional view of a safety brake device during operation of the actuator to move the pad to the second position according to an example of the present disclosure.
Figure 3A:
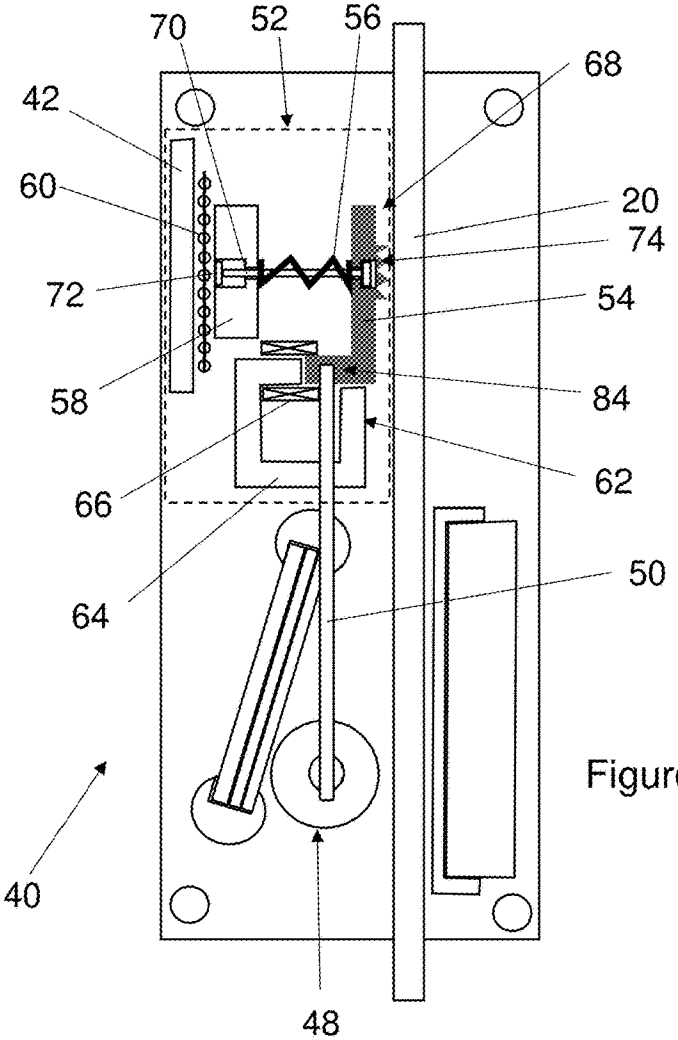
FIG. 3A is a schematic cross-sectional view of a safety brake device after reset according to an example of the present disclosure.
Figure 3C:
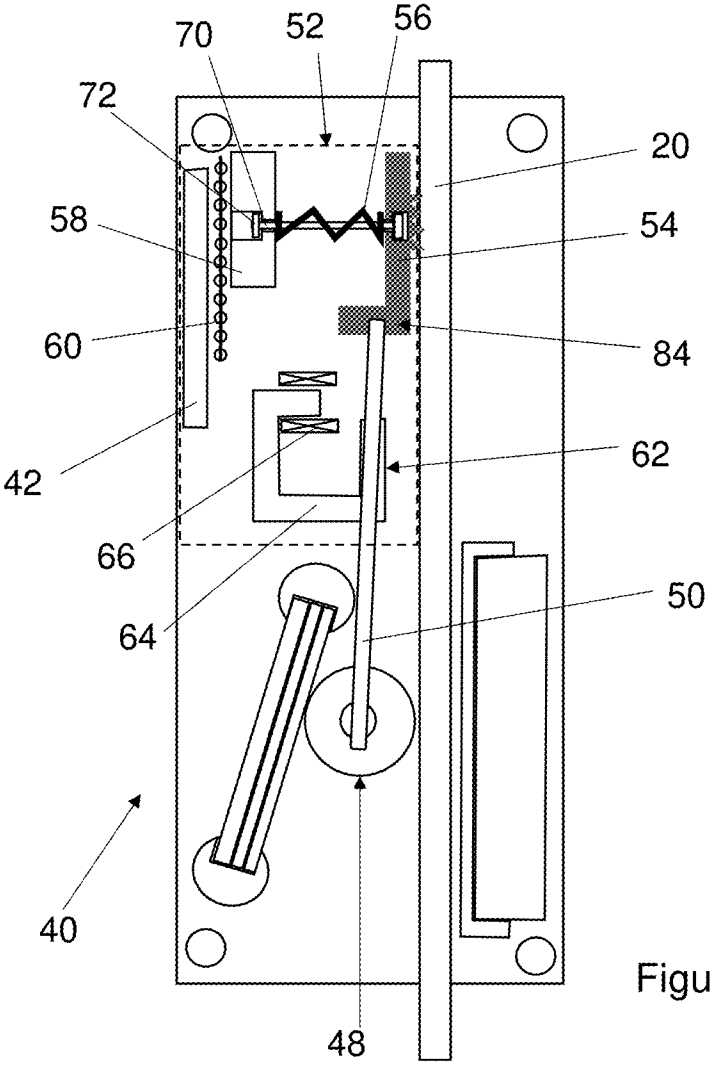
FIG. 3C is a schematic cross-sectional view of a safety brake device with the safety brake engaged according to an example of the present disclosure.

Turning now to FIGS. 3A, 3B and 3C, a schematic side view of the example of the safety brake device 40 shown in FIG. 2 in use is provided. FIGS. 3A-3C are shown in the frame of reference of the elevator car 16.

FIG. 3A shows the safety brake device 40 in a non-engaging position, e.g. upon initial installation or after reset. The safety brake device 40 is mounted onto an elevator car 16 via the mounting portion 42 such that the safety brake device 40 moves with the elevator car 16 up and down the guide rail 20. The pad 54 is held away from the guide rail 20 by the magnetic force provided by the electromagnet 62 which overcomes the biasing force provided by the spring 56. In this example the electromagnet 62 comprises a 'G-shaped' iron core 64 and an electrical coil 66. A controller (seen in FIG. 9) is in electrical communication with the electromagnet 62 and is configured to control a supply of electricity to the electrical coil 66. Therefore, when the safety brake device 40 is in a non-engagement position, as shown in FIG. 3A, the pad 54 is in the first position and not in contact with the guide rail 20, such that there is a gap 68 between the pad 54 and the guide rail 20.

The spring 56 is connected between the pad 54 and the support 58. A guiding rod 70 is arranged through the centre of the spring 56 and is connected to the support 58 and to the pad 54 by nuts 72. The guiding rod 70 is rigid and prevents buckling of the spring 56, as well as preventing the pad 54 from falling. The spring 56 is arranged to connect the centre of the pad 54 to the centre of the support 58 in order to reduce any torque on the spring 56 due to movement of the pad 54 and/or support 58. The pad 54 has a high friction surface 74 which is arranged to contact the guide rail 20 when in the second position.

In this example the pad includes a reset portion 84 that is arranged to form part of the ferromagnetic core 64 inside the electrical coil 66 when the pad 54 is in the first position. This means that the pad 54 completes the magnetic circuit of the electromagnet 62, assisting reset of the safety brake device 40

If a freefall, over-speed, or over-acceleration condition of the elevator car 16 is detected by the governor 22, the controller (seen in FIG. 9) removes or reduces electrical power to the electromagnet 62. On removal of power to the electrical coil 66, the pad 54 no longer experiences any magnetic force. As such, the biasing force applied by the spring 56 to the pad 54 moves the pad 54 from the first position shown in FIG. 3A to the second position shown in FIG. 3B when the elevator car 16 is descending too rapidly. The guiding rod 70 is movable within an opening in the support 58 such that when the pad 54 moves from the first to the second position, the guiding rod 70 also moves towards the guide rail 20 without pulling on the support 58. It can be seen from FIGS. 3A-3C how the guiding rod 70 helps to guide lateral movement of the pad 54 between the first and second positions.

The contact of the pad 54 with the guide rail 20, and in particular, the high-friction surface 74 contacting the guide rail 20, causes the connected support 58 and pad 54 to move upwards relative to the car 16. This movement is shown in FIG. 3C and occurs due to the frictional force between the guide rail 20 and the pad 54. The friction between the guide rail 20 and pad 54 results in an upwards reaction force. This is due to the downwards motion of the elevator car 16 and mounting portion 42 which is fixed to the elevator car 16, and the fixed position of the guide rail 20.

The pad 54, spring 56, support 58 and guiding rod 70 are able to move upwards due to the linear roller bearings 60 which allow motion of the support 58 relative to the mounting portion 42 of the actuator 52 up and down. As the support 58 and pad 54 move upwards due to the upwards reaction force, this upwards reaction force is applied to the linkage mechanism 50 which is connected between the pad 54 and the safety brake 48. The linkage mechanism 50 therefore transmits the upwards reaction force to the roller 48*a* of the safety brake 48 to move the roller 48*a* upwards along the inclined surface 48*b* into the braking position such that it engages the guide rail 20 and prevents further downwards motion of the elevator car 16, as shown in FIG. 3C. Therefore, when an over-speed or freefall condition of an elevator car 16 is detected by a safety controller (as described further below), the safety brake device 40 acts to prevent further downwards motion of the elevator car 16.

To reset the safety brake 48 and the actuator 52 of the safety brake device 40, the elevator car 16 is moved upwards with the mounting portion 42 until the electromagnet 62 is aligned with the pad 54, which disengages the safety brake 48. During the reset process, power is restored to the electromagnet 62 by the controller (seen in FIG. 9), creating an attractive magnetic force between the electromagnet 62 and pad 54. Re-alignment of the reset portion 84 with the ferromagnetic core 64 helps to strengthen the magnetic field and pull the pad 54 from its second position back to its first position. When this magnetic force is stronger than the biasing force caused by the spring 56, the pad 54 is therefore pulled laterally away from the guide rail 20 to the first position such that the gap 68 forms between the pad 54 and guide rail 20 (as seen in FIG. 3A).

Figure 4B:
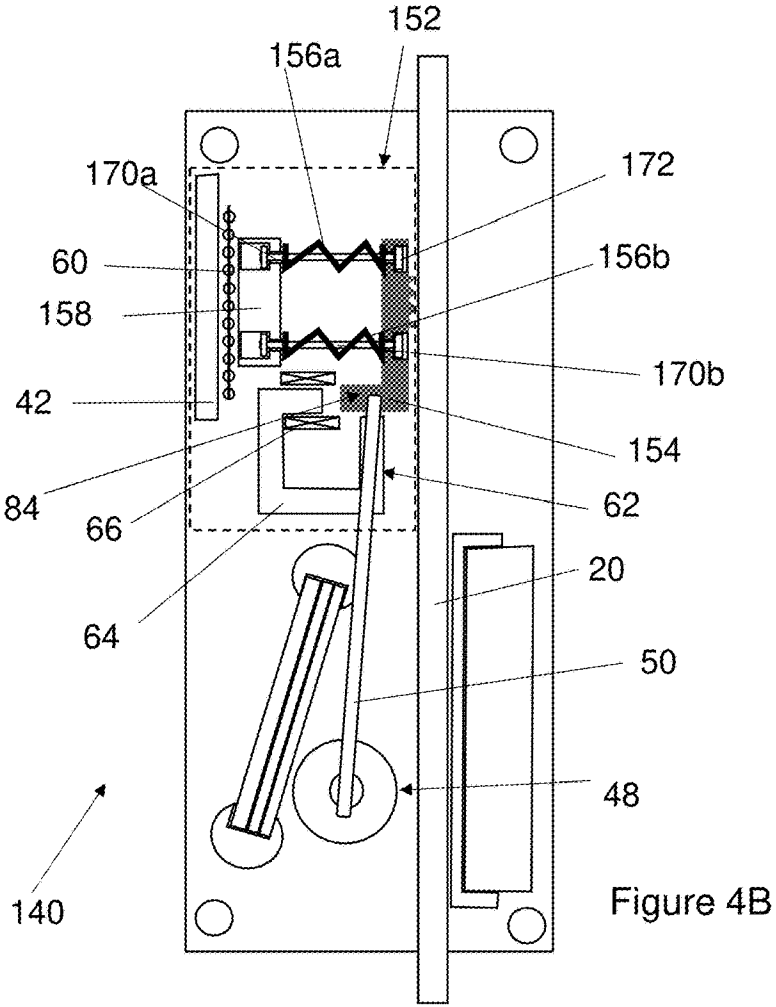
FIG. 4B is a schematic cross-sectional view of a safety brake device during operation of the actuator to move the pad to the second position according to a second example of the present disclosure.
Figure 4A:
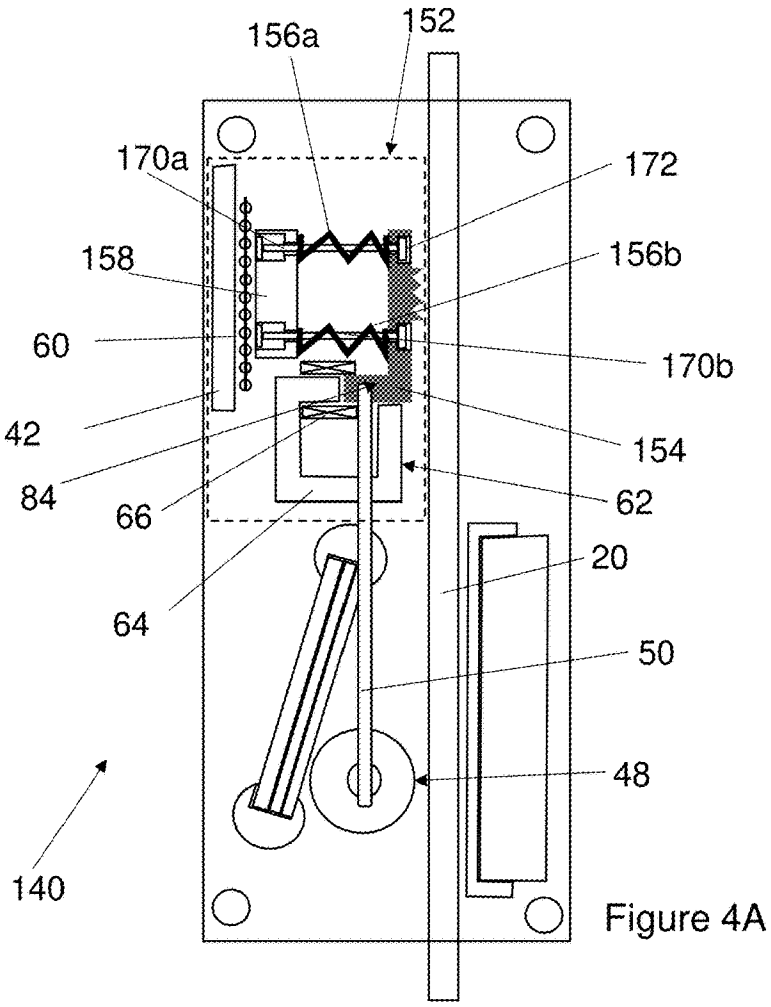
FIG. 4A is a schematic cross-sectional view of a safety brake device after reset according to a second example of the present disclosure.
Figure 4C:
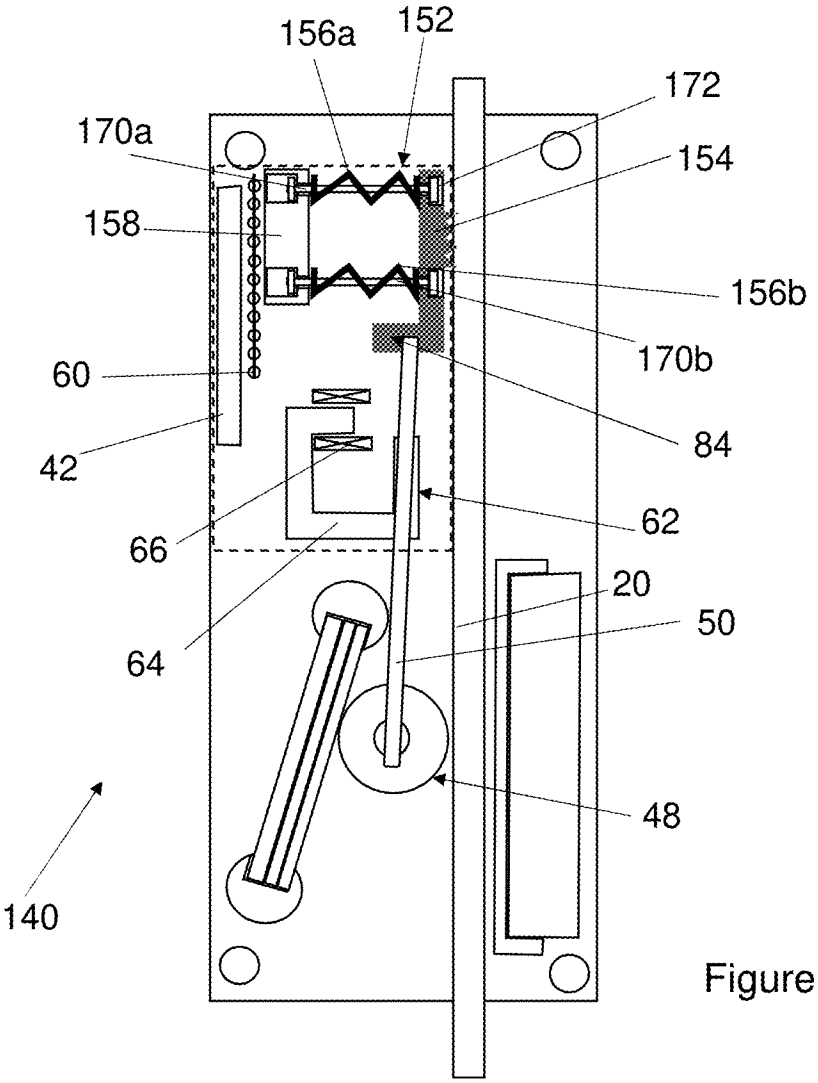
FIG. 4C is a schematic cross-sectional view of a safety brake device with the safety brake engaged according to a second example of the present disclosure.

A further example of the safety brake device is shown in FIGS. 4A-C. FIGS. 4A-4C are shown in the frame of reference of the elevator car 16. The safety brake device 140 displayed in FIGS. 4A-4C uses the same mechanism as the safety brake device 40 in FIGS. 3A-3C to engage the safety brake 48. However, the example of FIGS. 4A-4C uses two springs 156*a*, 156*b* and two guiding rods 170*a*, 170*b* in another version of the actuator 152. FIG. 4A is a schematic side view showing the safety brake device 140 at reset, FIG. 4B shows the safety brake device 140 when power has been reduced or removed from the electromagnet 62 such that the pad 154 moves to the second position in contact with the guide rail 20. FIG. 4C shows the safety brake device 140 with the safety brake 48 engaged. Each spring 156*a*, 156*b* is arranged to connect the support 158 and pad 154 in the actuator 152. The support 158 has two openings within which the guiding rods 170*a*, 170*b* are movable. The guiding rods 170*a*, 170*b* are each connected to the support 158 and pad 154 by nuts 172.

The spring 156*a* and associated guiding rod 170*a* are arranged to connect the top of the pad 154 to the top of the support 158. The spring 156*b* and associated guiding rod 170*b* are correspondingly arranged to connect the bottom of the support 158 to the lower part of the pad 154. This symmetric arrangement of springs and guiding rods ensures a balanced biasing force is provided to the pad 154. When power is removed from the electromagnet 62, the equal biasing forces provided by the two springs 156*a*, 156*b* will ensure a linear movement of the pad 154 towards the guide rail 20 for contact in the second position. Advantageously, in this example, the biasing force provided to the pad 154 is more balanced than the example of FIGS. 3A-3C. This means that during reset, where the car 16 is moved upwards and the magnetic force re-applied to the pad 154 to oppose the biasing forces, less torque will be applied to the pad 154 than in the example of FIGS. 3A-3C.

In the examples seen in FIGS. 3-4, the electromagnet 62 is fixed in the actuator 52, 152 relative to the mounting portion 42. This means that there is a vertical separation between the pad 54, 154 and the electromagnet 62 once the safety brake 48 is engaged. During reset, the elevator car has to be moved to bring the electromagnet 62 close enough to the pad 54 for the magnetic force to pull the pad 54 back to its first position. This can affect reset reliability. In another set of examples, described below in relation to FIGS. 5-8, the electromagnet is connected to the support so as to be moveable relative to the mounting portion.

Figure 5B:
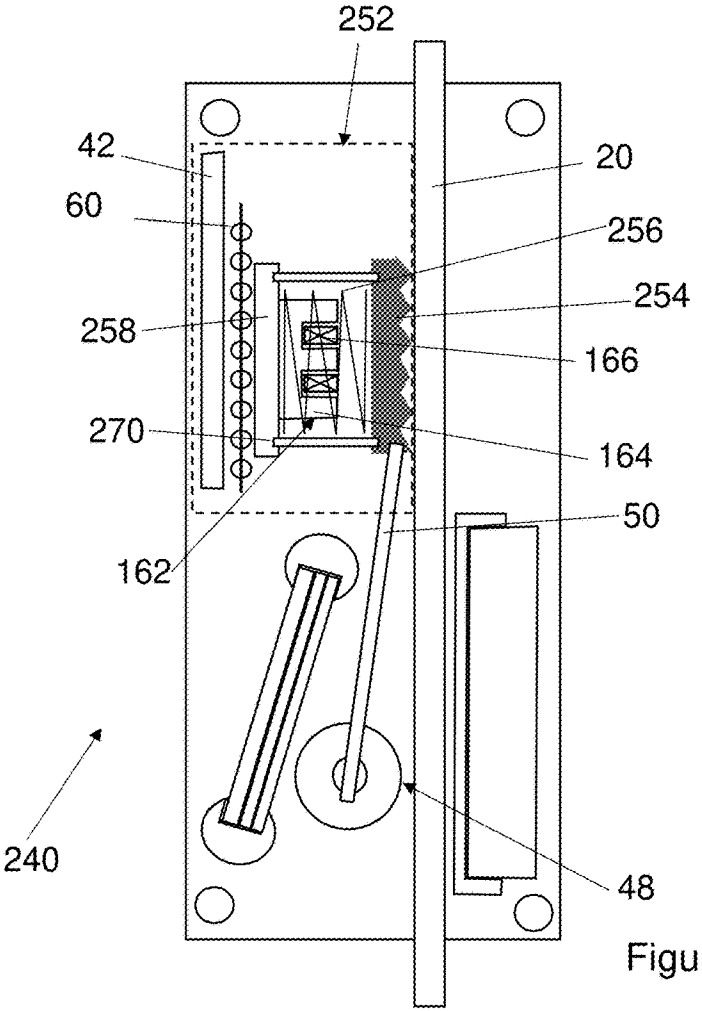
FIG. 5B is a schematic cross-sectional view of a safety brake device during operation of the actuator to move the pad to the second position according to a third example of the present disclosure.
Figure 5A:
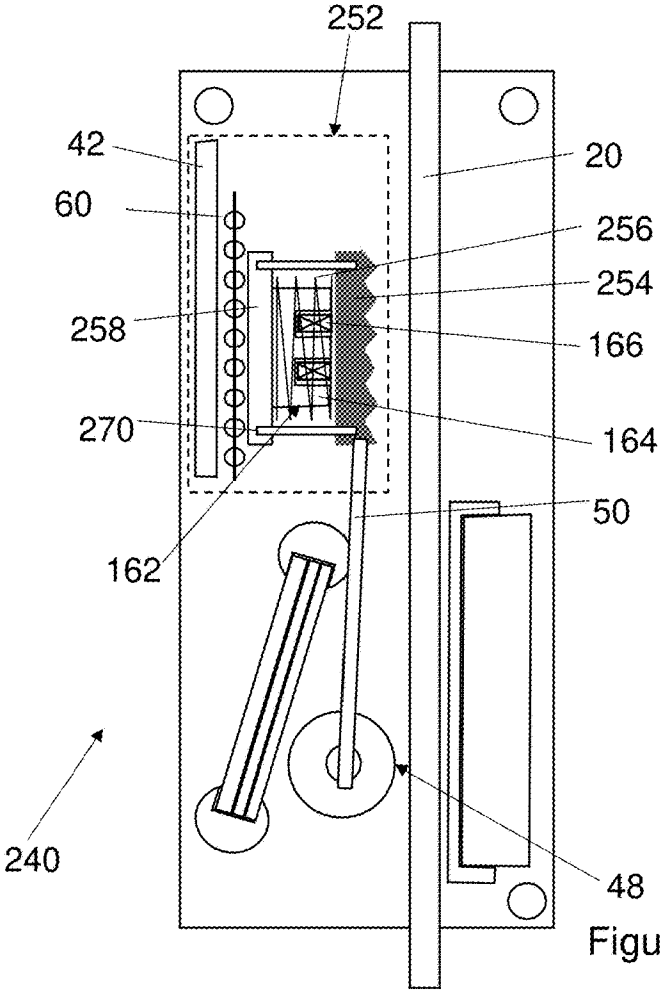
FIG. 5A is a schematic cross-sectional view of a safety brake device after reset according to a third example of the present disclosure.
Figure 5C:
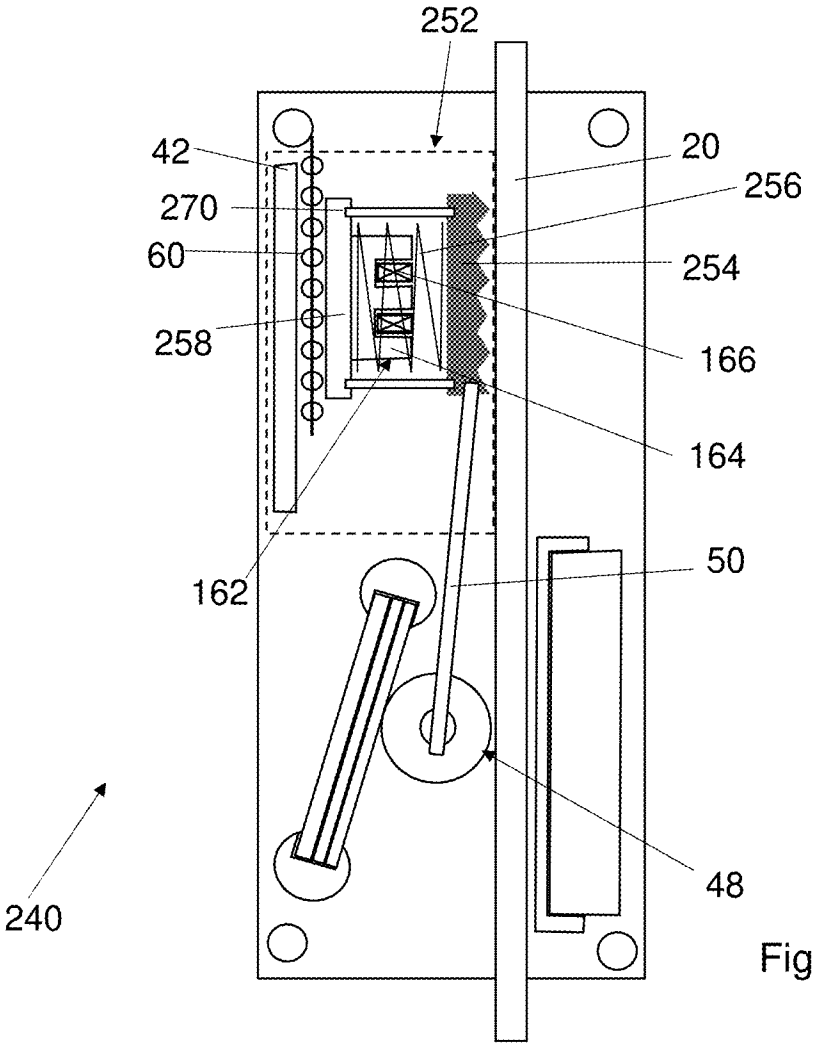
FIG. 5C is a schematic cross-sectional view of a safety brake device with the safety brake engaged according to a third example of the present disclosure.

A third example of the safety brake device is shown in FIGS. 5A-5C. FIGS. 5A-5C are shown in the frame of reference of the elevator car 16. In this example of the safety brake device 240, the electromagnet 162 comprises an 'E-shaped' iron core 164 and an electrical coil 166. As with previous examples, a controller (seen in FIG. 9) is in electrical communication with the electromagnet 162 and is configured to control a supply of electricity to an electrical coil 166.

Further to this, in contrast to the electromagnet 62 in the safety brake devices 40, 140 shown in FIGS. 2-4, the electromagnet 162 in the safety brake device 240 is not fixed in position relative to the mounting portion 42. The electromagnet 62 is connected to the support 258 which is in contact with linear roller bearings 60 and is therefore not fixed in position relative to the mounting portion 42. The system 240 of FIGS. 5A-5C uses a single spring 256. This spring 256 is arranged to surround the electromagnet 162, such that both the spring 256 and electromagnet 162 span the distance between the support 258 and the pad 254 when the pad 254 is in the first position. Guiding rods 270 connect the pad 254 to the support 258 and prevent the pad 254 from falling downwards.

The linkage 50 is connected between the safety brake 48 and the actuator 252. When over-speed is detected by the governor 22, the controller (seen in FIG. 9) reduces or interrupts power to the electromagnet 162. As such, the biasing force provided by the spring 256 pushes the pad 254 to the second position, in contact with the guide rail 20, as shown in FIG. 5B. Due to the relative downwards motion of the elevator car 16, the pad 254, and support 258 then move upwards relative to the car 16 and mounting portion 42, rolling along the linear roller bearings 60. As the electromagnet 162 is fixed to the support 258, the electromagnet 162 also moves upwards. The linkage mechanism 50 which is connected to the pad 254 is also pulled upwards, therefore pulling the safety brake 48 into the engaged position and stopping motion of the elevator car 16 (see FIG. 5C).

To reset the safety brake 48 and the actuator 252 of the safety brake device 240, power is restored to the electromagnet 262 by the controller (seen in FIG. 9), creating an attractive magnetic force between the electromagnet 262 and pad 254. As the electromagnet 254 moved upwards with the support 258 during braking, power may be restored to the electromagnet 262 at the start of the reset process. The electromagnet 262 will therefore pull the pad 254 from its second position back to its first position. When this magnetic force is stronger than the biasing force caused by the spring 256, the pad 254 is therefore pulled laterally away from the guide rail 20 to the first position. The elevator car 16 is then moved upwards with the mounting portion 242, disengaging the safety brake 48. Reset may be more reliable in this example reliable than in a safety brake device where the electromagnet 262 does not move with the support 258.

Figure 6B:
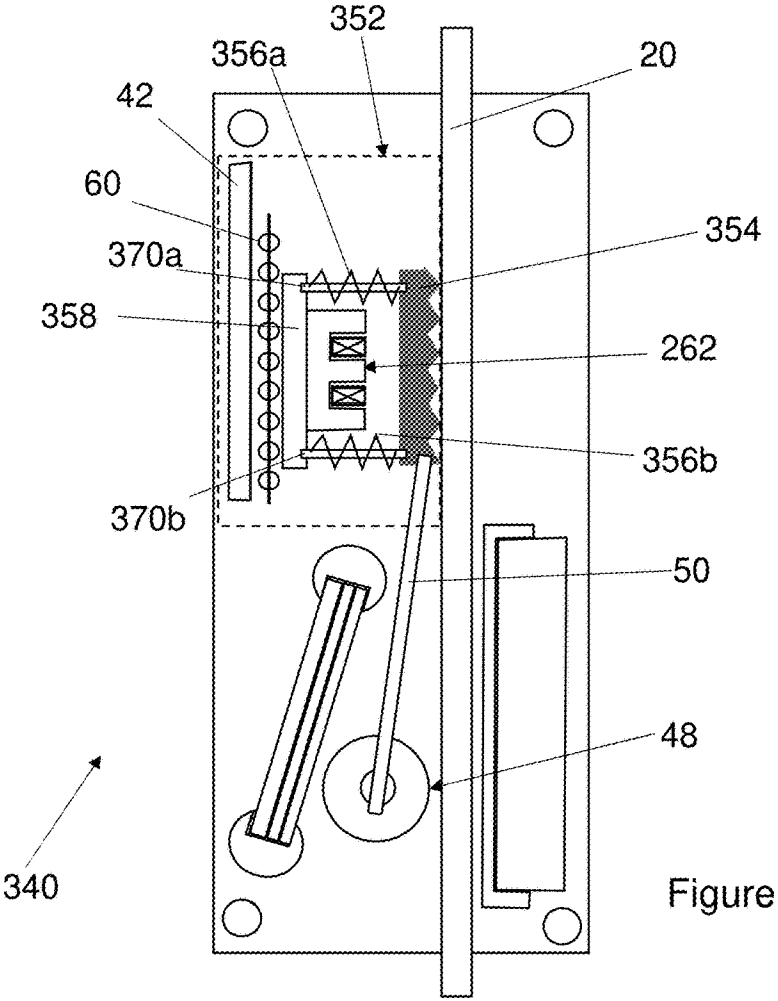
FIG. 6B is a schematic cross-sectional view of a safety brake device during operation of the actuator to move the pad to the second position according to a fourth example of the present disclosure.
Figure 6A:
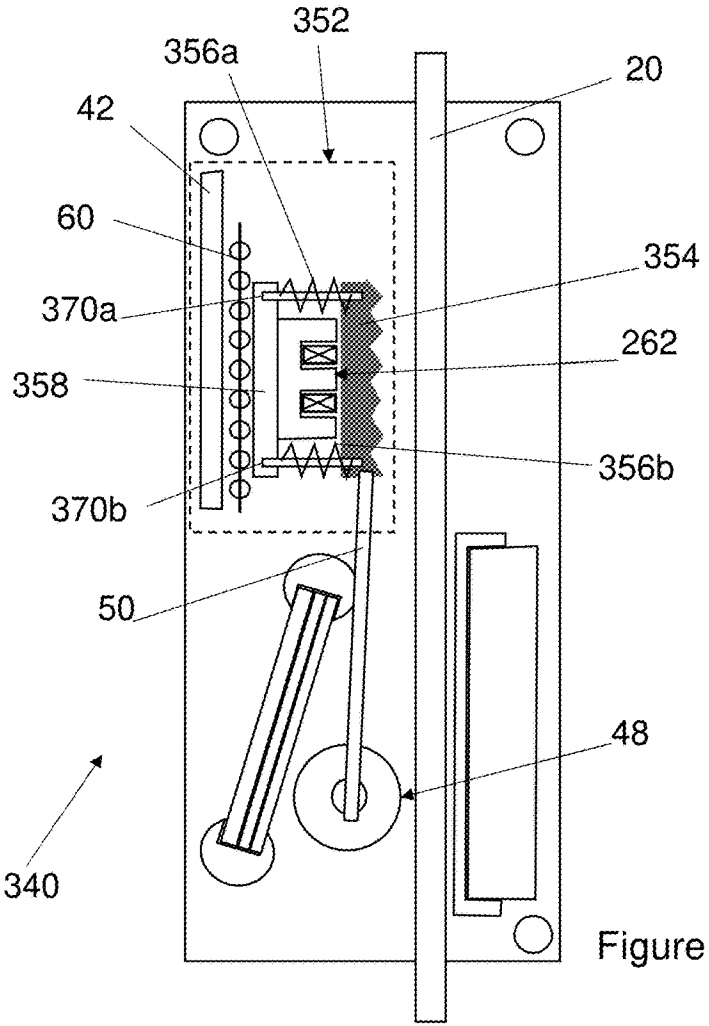
FIG. 6A is a schematic cross-sectional view of a safety brake device after reset according to a fourth example of the present disclosure.
Figure 6C:
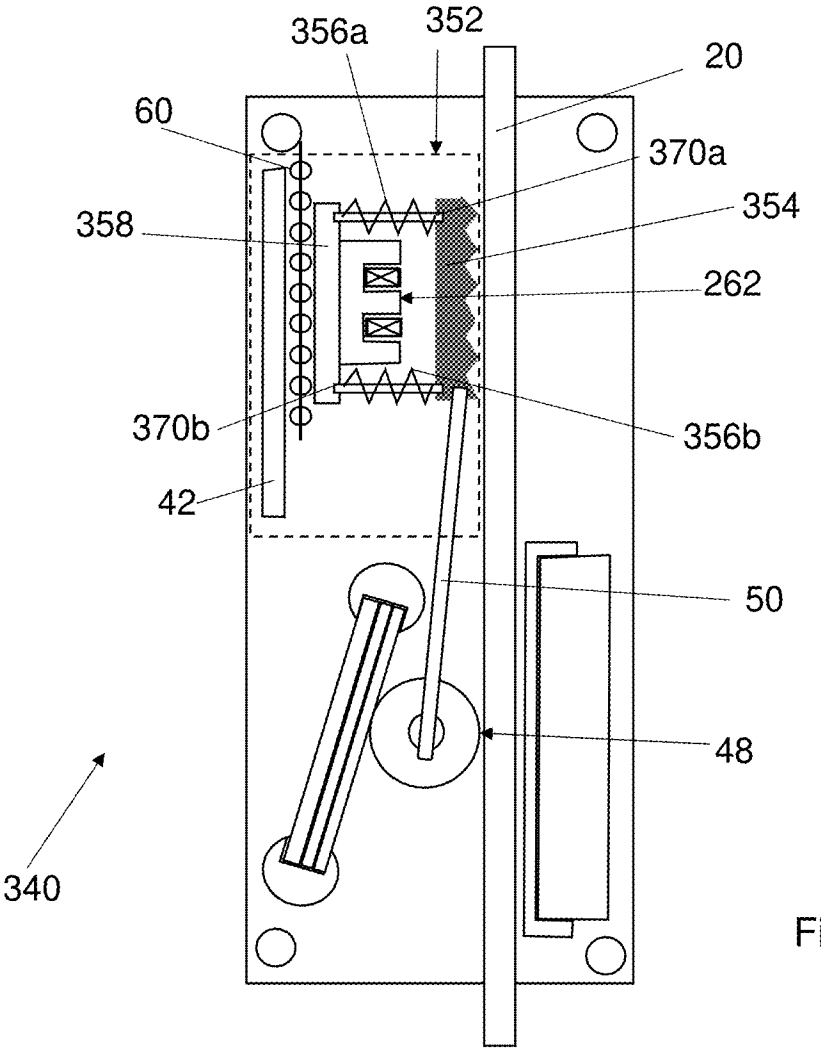
FIG. 6C is a schematic cross-sectional view of a safety brake device with the safety brake engaged according to a fourth example of the present disclosure.

A fourth example is shown in FIGS. 6A-6C. FIGS. 6A-6C are shown in the frame of reference of the elevator car 16. Similarly to the example shown in FIGS. 5A-5C, the safety brake device 340 of FIGS. 6A-6C uses an electromagnet 262 which is fixed to the support 358. As such, the electromagnet 262 moves upwards with the support 358 and pad 354 when power is removed to the electromagnet 262 and the pad 354 moves laterally from the first to the second position in contact with the guide rail 20.

In this example, two springs 356*a*, 356*b* and two guiding rods 370*a*, 370*b* are used. Each spring 356*a*, 356*b* surrounds a corresponding guiding rod 370*a*, 370*b* and the springs 356*a*, 356*b* and guiding rods 370*a*, 270*b* connect the support 358 to the pad 354. Therefore, each guiding rod 370*a*, 370*b* prevents each spring 356*a*, 356*b* from buckling, as well as preventing the pad 354 from falling.

The upper spring 356*a* and associated guiding rod 370*a* are arranged to connect the top of the pad 354 to the top of the support 358 in the actuator 352. The lower spring 356*b* and associated guiding rod 370*b* are correspondingly arranged to connect the bottom of the support 358 to the lower part of the pad 354. The electromagnet 262 is coupled to the support 358 between the two springs 356*a*, 356*b* and guiding rods 370*a*, 370*b*. This symmetric arrangement of springs 356*a*, 356*b*, guiding rods 370*a*, 370*b* and central electromagnet 362 ensures the forces acting on the pad 354 are balanced. The springs 356*a*, 356*b* will provide a biasing force to the pad 354 and the electromagnet 362 provides a magnetic force to the pad 354. The overall force therefore acts through the centre of the pad 354, such that there is no torque on the pad 354. Advantageously, in this example, during reset of the safety brake device 340, the balanced forces provides by the springs 356*a*, 356*b*, guiding rods 370*a*, 370*b* and electromagnet 362 ensures that reset is more reliable than in a safety brake device where the total force is not acting through the centre of the pad 354.

Figure 7B:
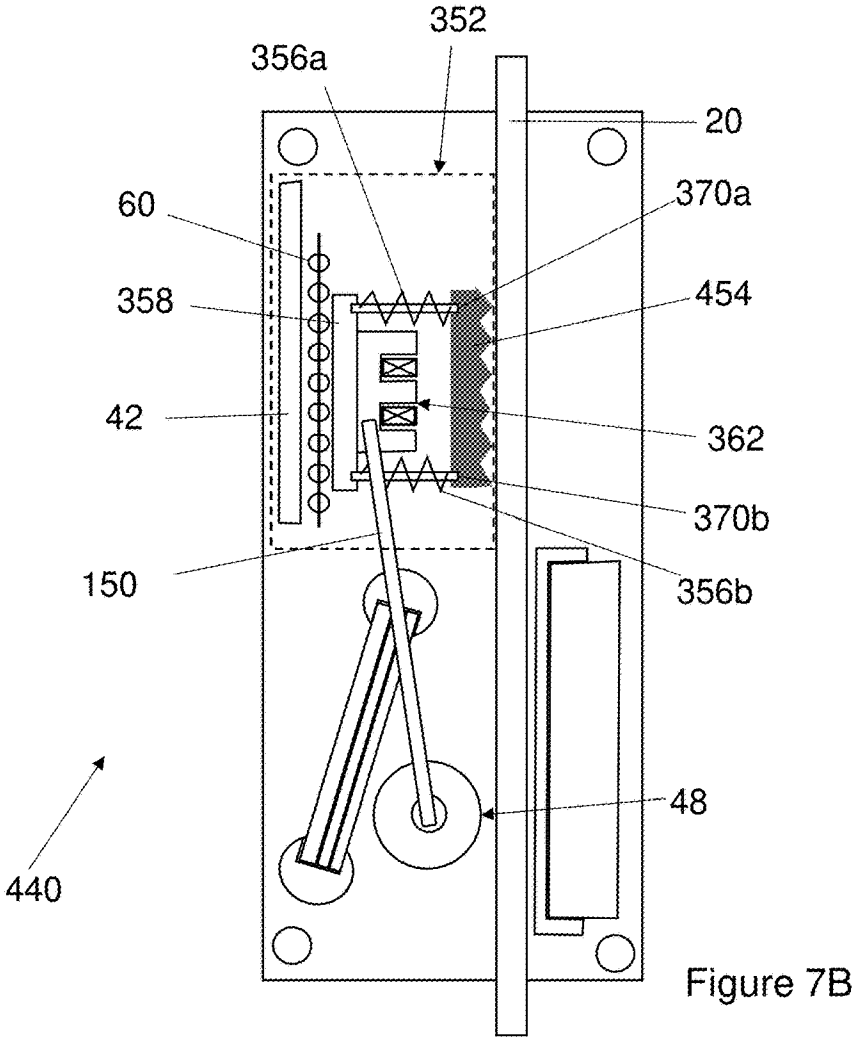
FIG. 7B is a schematic cross-sectional view of a safety brake device during operation of the actuator to move the pad to the second position according to a fifth example of the present disclosure.
Figure 7A:
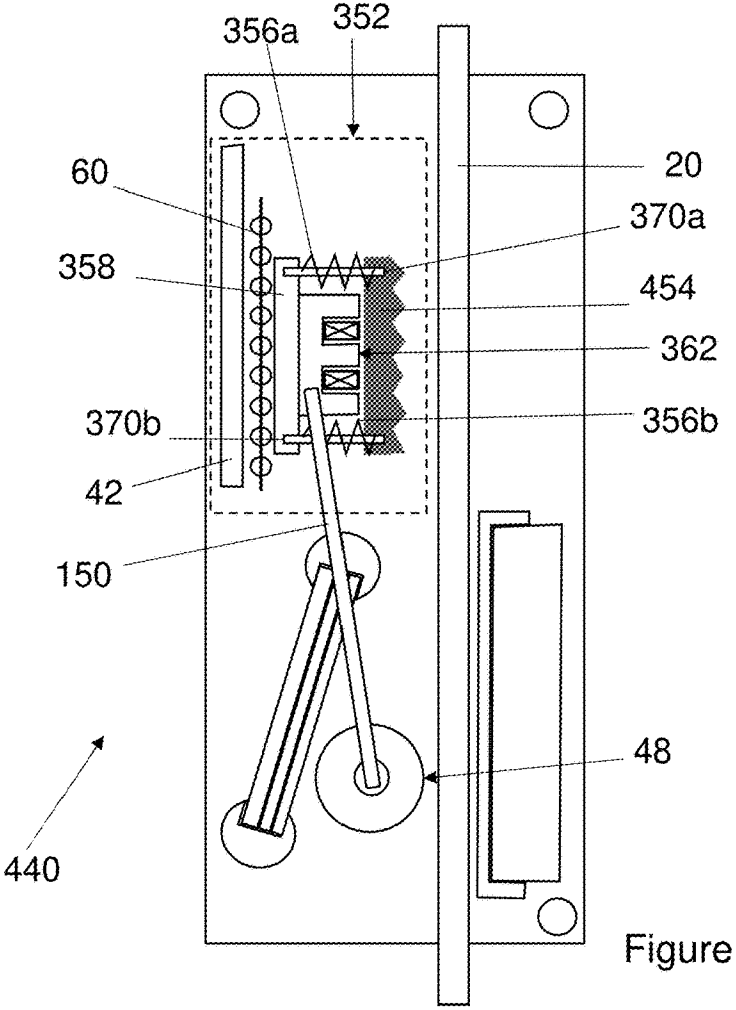
FIG. 7A is a schematic cross-sectional view of a safety brake device after reset according to a fifth example of the present disclosure.
Figure 7C:
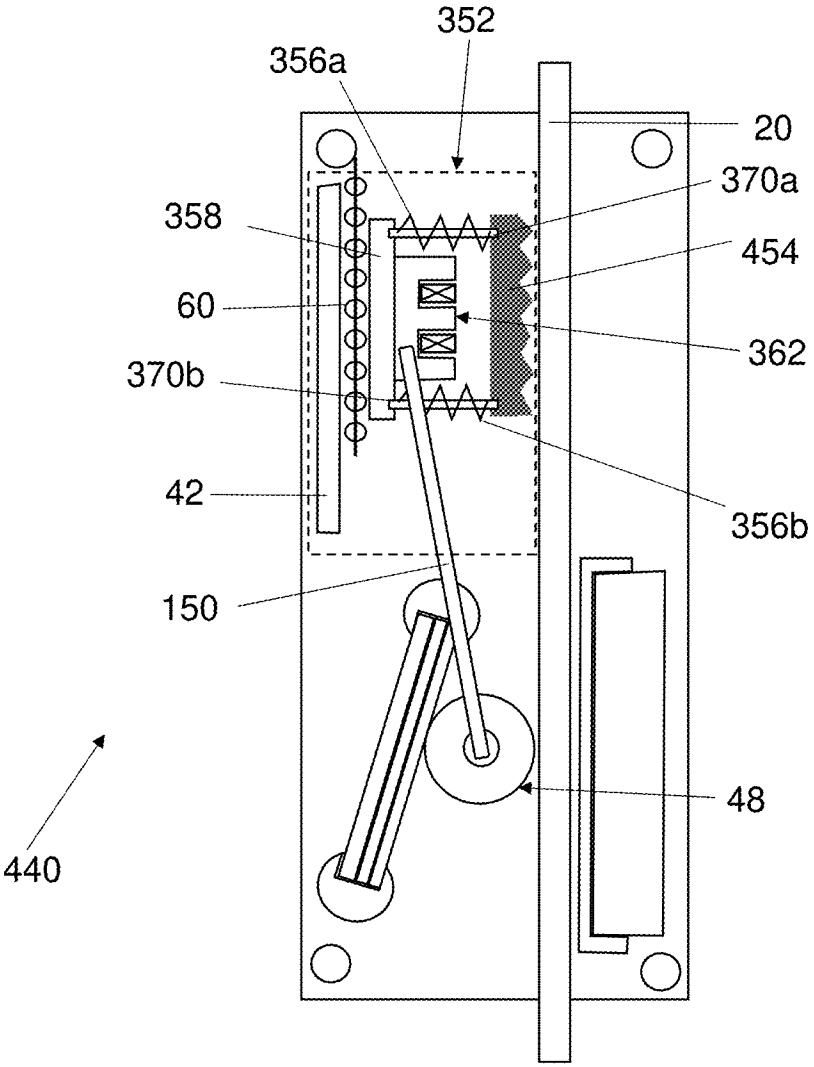
FIG. 7C is a schematic cross-sectional view of a safety brake device with the safety brake engaged according to a fifth example of the present disclosure.

A fifth example is shown in FIGS. 7A-7C. FIGS. 7A-7C are shown in the frame of reference of the elevator car 16. This example uses the same spring 356*a*, 356*b*, guiding rod 370*a*, 370*b* and electromagnet 362 arrangement as that of FIGS. 6A-6C. However in the safety brake device 440 of FIGS. 7A-7C, the linkage mechanism 150 is connected between the safety brake 48 and the electromagnet 362, as opposed to previous examples where the linkage mechanism is connected between the safety brake 48 and the pad. Motion of the electromagnet 362 upwards therefore transmits an upwards force through the linkage 150 to the safety brake 48, causing the safety brake 48 to engage with the elevator car 16 and prevent downwards motion.

The friction between the guide rail 20 and pad 454 when the pad 454 is in the second position, shown in FIG. 7B results in an upwards reaction force applied to the pad 454, electromagnet 362 and support 358. This is due to the downwards motion of the elevator car 16 and mounting portion 42 which is fixed to the elevator car, and the fixed position of the guide rail 20.

The pad 454, springs 356*a*, 356*b*, support 358 and guiding rods 370*a*, 370*b* are able to move upwards due to the linear roller bearings 60 between the support 358 and mounting portion 42 which allow motion up and down relative to the mounting portion 42. The electromagnet 362 is also connected to the support 358, and as such moves with the pad 454 etc. As the pad 454, electromagnet 362 and support 358 move upwards due to the upwards reaction force, this upwards reaction force is applied to the linkage mechanism 150 which is connected to the electromagnet 362 and safety brake 48. The linkage mechanism 150 therefore transmits the upwards reaction force to the safety brake 48 to move the safety brake 48 upwards into the braking position such that it engages and prevents further downwards motion of the elevator car 16, as shown in FIG. 7C. Therefore, when an over-speed or freefall condition of an elevator car 16 is detected by a safety controller, the safety brake device 440 acts to prevent further downwards motion of the elevator car 16.

Figure 8B:
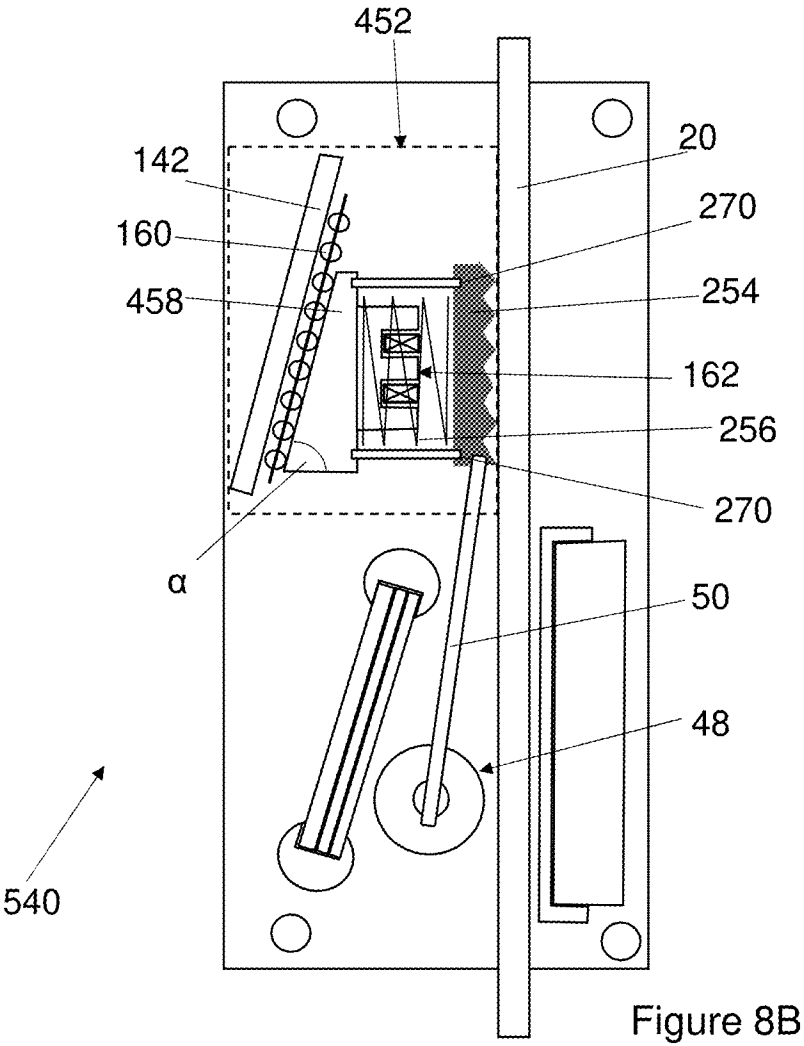
FIG. 8B is a schematic cross-sectional view of a safety brake device during operation of the actuator to move the pad to the second position according to a sixth example of the present disclosure.
Figure 8A:
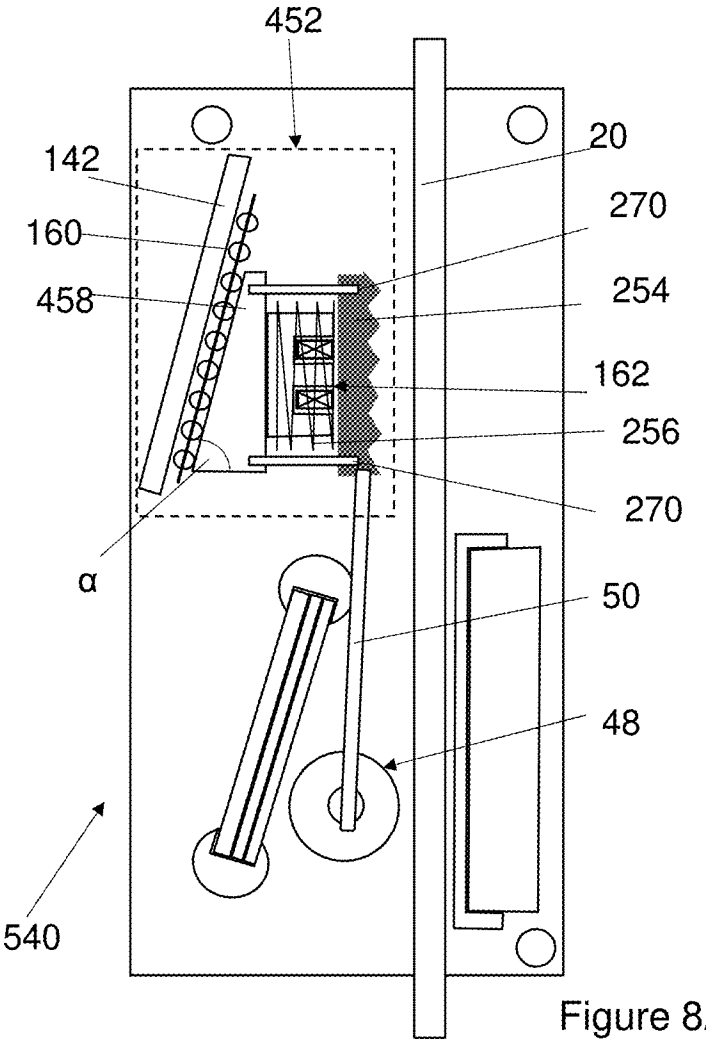
FIG. 8A is a schematic cross-sectional view of a safety brake device after reset according to a sixth example of the present disclosure.
Figure 8C:
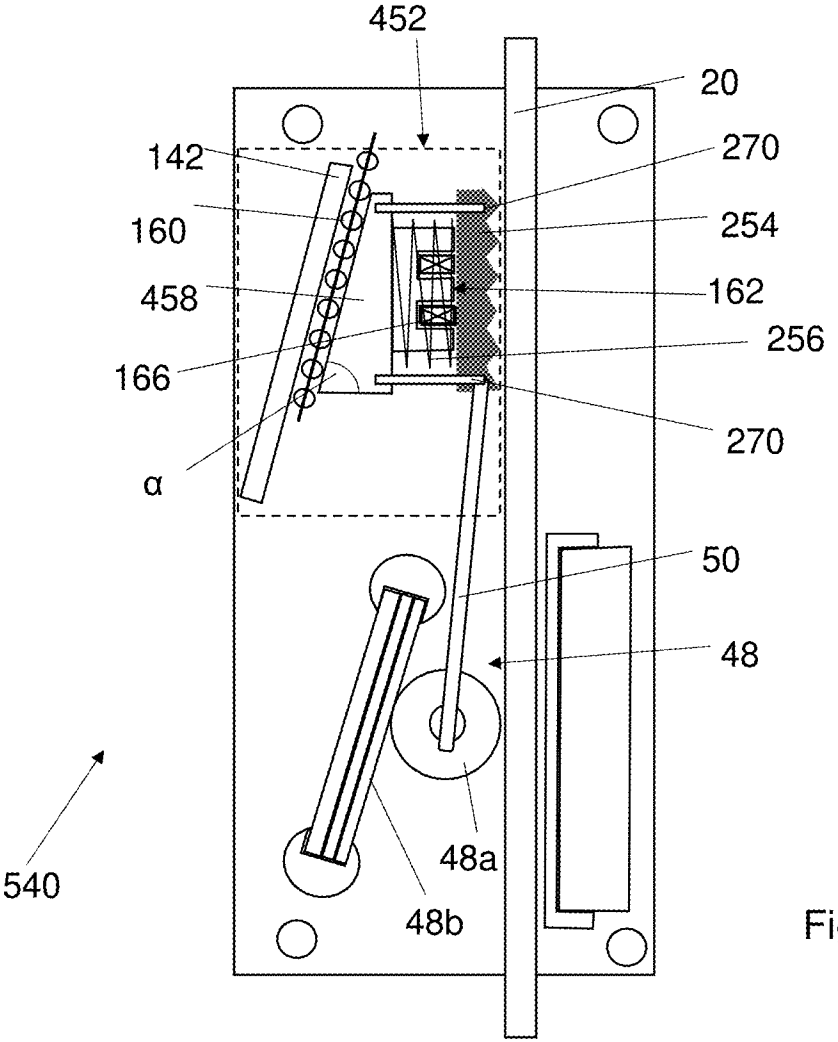
FIG. 8C is a schematic cross-sectional view of a safety brake device with the safety brake engaged according to a sixth example of the present disclosure.

Turning now to FIGS. 8A-8C, a sixth example of the safety brake device 540 is shown. FIGS. 8A-8C are shown in the frame of reference of the elevator car 16. The safety brake device 540 uses the same spring 256, guiding rods 270 and electromagnet 162 arrangement as that of FIGS. 5A-6C. However, the linear roller bearings 160 are at an acute angle a relative to the lateral direction of movement of the pad 254 between the first and second positions. The support 458 is therefore wedge-shaped, as opposed to the rectangular shaped supports shown in FIGS. 2-7. The support 458 is seen to have an acute angle a between the horizontal base of the support 458 and the side surface of the support in contact with the linear roller bearings 160, i.e. this bearing surface 160 is oriented at the acute angle $\alpha$ relative to the horizontal direction.

The acute angle a of the support 458 and linear roller bearings 160 enables the actuator 452 of the safety brake device 540 to self-reset. The system 540 engages the safety brake 48 using the same method as that shown in FIGS. 5A-5C. The linkage 50 is connected between the safety brake 48 and the pad 254. When over-speed is detected by the governor 22, the controller (seen in FIG. 9) reduces or interrupts power to the electromagnet 162. As such, the biasing force provided by the spring 256 pushes the pad 254 to the second position, in contact with the guide rail 20, as shown in FIG. 8B. Due to the relative downwards motion of the elevator car 16, the pad 254 and support 458 then move upwards relative to the mounting portion 142, rolling along the angled linear roller bearings 160. As the electromagnet 162 is fixed to the support 458, the electromagnet 162 also moves upwards with the support 458. Due to the angle a of the support 458 and linear roller bearings 160, the spring 256 is compressed as the support 458 moves upwards. The electromagnet 162 and support 458 therefore also displace laterally towards the guide rail 20 as they move upwards relative to the mounting portion 142 due to the angle $\alpha$. The linkage mechanism 50 which is connected to the pad 254 is also pulled upwards, and the linkage mechanism 50 therefore pulls the safety brake 48 into the engaged position and stops motion of the elevator car 16.

The safety brake device 540 is shown in FIG. 8C with the safety brake 48 engaged. The actuator 452 is arranged to "self-reset" in this example. As shown in FIG. 8C, movement of the support 458, electromagnet 162 and pad 254 upwards also causes the electromagnet 162 and support 458 to displace laterally towards the guide rail 20. The gap between the pad 254 and electromagnet 162 is therefore reduced, e.g. to zero or almost zero. The current necessary to be applied to the electrical coil 166 to reset the actuator 452 is therefore approximately equal to the current level which, when applied to the electrical coil 166 of the electromagnet 162, will cause the electromagnet 162 to exert a magnetic force on the pad 254 which is approximately equal to the biasing force provided by the spring 256, and will therefore counter this biasing force such that the pad 254 is held in contact with the electromagnet 162 without the magnetic force needing to pull in the pad 254.

Once the safety brake 48 is engaged, the elevator car 16 will be brought to a stop. In order to disengage the safety brake 48, the elevator car 16 is moved upwards. The roller 48*a* is therefore no longer compressed between the guide rail 20 and wedged surface 48*b*. The safety brake 48 will therefore move downwards due to gravity, pulling on the linkage 50 which therefore also moves the actuator 452 to its initial position shown in FIG. 8A. As such, the angled support 458 and linear roller bearings 160 enable "self-reset" of the actuator 452 due to the minimal current which may be applied to the electrical coils 166 in order to reset the actuator 452. In comparison, the actuators of FIGS. 3-7 will require a much stronger current to be applied to the electrical coils 66, 166 to reset the actuators 52, 152, 252, 352, to both overcome the biasing force provided by the spring, and due to the distance the pad must displace to be in the first position. The acute angle a may range between 75° and 90°. The support 458 may be angled similarly to the angled "wedge" surface 48*b* of the safety brake 48.

In any of the examples disclosed above, the linkage 50, 150 may be connected to the support 58, 158, 258, 358, 458 instead of the pad 54, 154, 254, 354 or electromagnet 362. The support 58, 158, 258, 358, 458 moves upwards due to the upwards reaction force when the pad 54, 154, 254, 354, 454 moves from the first to the second position so may transmit the upwards reaction force to the linkage 50, 150, and therefore to the safety brake 48.

In any of the examples disclosed above, the linear roller bearings 60, 160 may be replaced by any suitable bearing parts or a bearing surface, for example a relatively low friction surface interface between the support and the mounting portion. For example, the support may have a low friction surface or surface coating to aid its movement relative to the mounting portion. A lubricant may be used as well or instead of any bearing parts.

In any of the examples disclosed above, the linkage mechanism (50) may take any suitable form for mechanical transmission of the upwards reaction force. Although the linkage mechanism (50) has been illustrated in the form of a bar, it could be a wire, or a series of link members, or a plate, for example.

Figure 9:
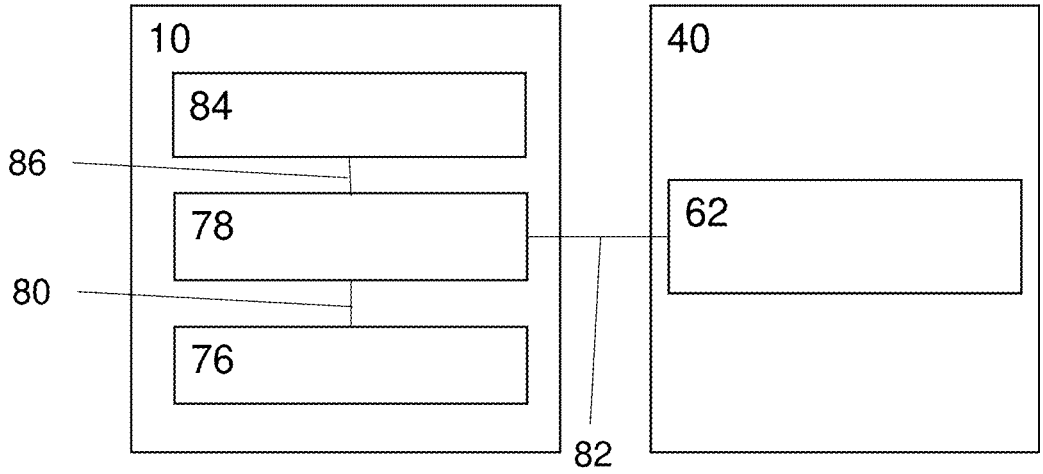
FIG. 9 is a schematic block diagram of emergency braking control for the elevator system and safety brake device according to an example of the present disclosure.

FIG. 9 shows a schematic block diagram of emergency braking control for the elevator system 10 and safety brake device 40. The safety brake device 40 is mounted onto the elevator car 16. The elevator system 10 further comprises a speed sensor 76, accelerometer 84 and a safety controller 78. The speed sensor 76 measures the speed of descent and ascent of the elevator car 16. The accelerometer 84 measures the acceleration of the elevator car 16. The safety controller 78 is arranged to receive a speed signal 80 from the speed sensor 76, and an acceleration signal 86 from the accelerometer 84, and to control an electrical power supply 82 to the electromagnet 62 in the safety brake device 40. The safety controller 78 will selectively reduce or disconnect the electrical power supply 82 to the electromagnet 62, e.g. upon the safety controller 78 detecting an overspeed condition for the elevator car 16 based on the speed signal 80, or upon the safety controller 78 detecting an over-acceleration condition for the elevator car 16 based on the speed signal 80 or the acceleration signal 86.

It will be appreciated by those skilled in the art that the disclosure has been illustrated by describing one or more examples thereof, but is not limited to these examples; many variations and modifications are possible, within the scope of the accompanying claims. For example, the safety brake device may be used in a roped or ropeless elevator system, or another type of conveyance system.

What is claimed is:

1. A safety brake device (40; 140; 240; 340; 440; 540) for use in a conveyance system (10) including a guide rail (20) and a component (16) moveable along the guide rail (20), the safety brake device (40; 140; 240; 340; 440) comprising:

a safety brake (48) moveable between a non-braking position where the safety brake (48) is not in engagement with the guide rail (20) and a braking position where the safety brake (48) is engaged with the guide rail (20);

an actuator (52; 152; 252; 352; 452) for the safety brake (48), the actuator (52; 152;

252; 352; 452) comprising:

a mounting portion (42) for mounting the actuator (52; 152; 252; 352; 452) to the component (16), a pad (54; 154; 254; 354; 454) arranged to be moveable relative to the mounting portion (42) between a first position spaced from the guide rail (20) and a second position in contact with the guide rail (20), and at least one biasing member (56) configured to apply a biasing force to move the pad (54; 154; 254; 354; 454) from the first position to the second position;

and a linkage mechanism (50) coupled between the safety brake (48) and the actuator (52; 152; 252; 352; 452) such that, when the mounting portion (42) is moving downwards relative to the guide rail (20), movement of the pad (54) to the second position creates an upwards reaction force transmitted by the linkage mechanism (50) to move the safety brake (48) into the braking position;

wherein the pad (54; 154; 254; 354; 454) comprises a ferromagnetic material and the actuator (52; 152; 252; 352; 452) further comprises an electromagnet (62; 162; 262; 362. operable to apply a magnetic field to the (54; 154; 254; 354; 454) and thereby create a magnetic force acting against the biasing force to move the pad (54; 154; 254; 354; 454) towards the first position;

wherein the pad (54; 154; 254; 354; 454) is connected to a support (58; 158; 258; 358; 458) which is movable upwards relative to the mounting portion (42; 142) in response to the upwards reaction force, wherein the biasing member extends between the pad and the support.

2. The safety brake device (40; 140; 240; 340; 440) of claim 1, wherein the pad (54; 154; 254; 354; 454) is non-magnetic.

3. The safety brake device (40; 140) of claim 1, wherein the electromagnet (62) comprises an electrical coil (66) and a ferromagnetic core (64), and wherein the pad (54; 154) includes a reset portion (84) that is arranged in the first position to form part of the ferromagnetic core (64).

4. The safety brake device (40; 140) of claim 1, wherein the electromagnet (62) is fixed relative to the mounting portion (42).

5. The safety brake device (40; 140; 240; 340; 440; 540) of claim 1, further comprising a bearing surface (60; 160) arranged between the support (58; 158; 258; 358; 458) and the mounting portion (42; 142) which enables upwards movement of the support (58; 158; 258; 358; 458) relative to the mounting portion (42; 142).

6. The safety brake device (40; 140; 240; 340; 440; 540) of claim 1, comprising at least one guiding rod (70; 170, 270, 370) arranged to connect the pad (54; 154; 254; 354; 454) to the support (58; 158; 258; 358; 458) so as to guide lateral movement of the pad (54; 154; 254; 354; 454) from the first position to the second position relative to the support (58; 158; 258; 358; 458).

7. The safety brake device (240; 340; 440; 540. of claim 1, wherein the electromagnet (162; 262; 362) is connected to the support (258; 358; 458) so as to be moveable relative to the mounting portion (42; 142).

8. The safety brake device (240; 340; 440; 540) of claim 7, wherein the electromagnet (162; 262; 362) is connected to the support (258; 358; 458), and the at least one biasing member (256; 356) is connected to the support (258; 358; 458) and to the pad (254; 354; 454), in a symmetrical arrangement such that the biasing force applied to move the pad (254; 354; 454) from the first position to the second position is opposed by the magnetic force without applying a torque to the pad (254; 354; 454).

9. The safety brake device (540) of claim 1, wherein the support (458) comprises a surface (160) arranged to move upwards and downwards relative to the mounting portion (142), the surface (160) oriented at an acute angle ($\alpha$) relative to a direction of lateral movement of the pad (254) between the first position and the second position.

10. The safety brake device (40; 140; 240; 340; 440; 540) of claim 1, wherein the mounting portion (42; 142) also mounts the safety brake (48) to the component (16) such that the safety brake device (40; 140; 240; 340; 440; 540) is a single integrated unit.

11. An elevator system (10) comprising an elevator car (16) driven to move along at least one guide rail (20), and the safety brake device (40; 140; 240; 340; 440; 540) of claim 1, wherein the mounting portion (42, 142) is mounted to the elevator car (16) and the safety brake (48) is arranged to be moveable between the non-braking position where the safety brake (48) is not in engagement with the guide rail (20) and the braking position where the safety brake (48) is engaged with the guide rail (20).

12. The elevator system (10) of claim 11, comprising a speed sensor (76) and a safety controller (78) arranged to receive a speed signal (80) from the speed sensor (76) and to selectively reduce or disconnect an electrical power supply to the electromagnet (62; 162; 262; 362) upon detecting an overspeed or over-acceleration condition for the elevator car (16) based on the speed signal; and/or comprising an accelerometer (84) and a safety controller (78) arranged to receive an acceleration signal (86) from the accelerometer (84) and to selectively reduce or disconnect an electrical power supply to the electromagnet (62; 162; 262; 362) upon detecting an over-acceleration condition for the elevator car (16).

13. A method of operating a safety brake in a safety brake device (40; 140; 240; 340; 440; 540), the safety brake (48) moveable between a non-braking position where the safety brake (48) is not in engagement with a guide rail (20) and a braking position where the safety brake (48) is engaged with a guide rail (20), the safety brake device (40; 140; 240; 340; 440; 540) comprising:

an actuator (52; 152; 252; 352; 452) comprising:

a mounting portion (42) for mounting the actuator (52; 152; 252; 352; 452) to a component (16) moveable along a guide rail (20);

a pad (54; 154; 254; 354; 454) arranged to be moveable relative to the mounting portion (42) between a first position spaced from the guide rail (20) and a second position in contact with the guide rail (20), the pad (54; 154; 254; 354; 454) comprising a ferromagnetic material;

at least one biasing member (56) configured to apply a biasing force to move the pad (54; 154; 254; 354; 454) from the first position to the second position; and an electromagnet (62; 162; 262; 362); and a linkage mechanism (50) coupled between the safety brake (48) and the actuator (52; 152; 252; 352; 452); the method comprising:

operating the electromagnet (62; 162; 262; 362) in a normal mode to apply a magnetic field to the pad (54; 154; 254; 354; 454) and thereby create a magnetic force acting against the biasing force to move the pad (54; 154; 254; 354; 454) towards the first position; and operating the electromagnet (62; 162; 262; 362) in an emergency stop mode to reduce or remove the magnetic force acting against the biasing force such that the pad (54) moves to the second position to create an upwards reaction force when the mounting portion (42) is moving downwards relative to the guide rail (20), the upwards reaction force being transmitted by the linkage mechanism (50) to move the safety brake (48) into the braking position;

wherein the pad (54; 154; 254; 354; 454) is connected to a support (58; 158; 258; 358; 458) which is movable upwards relative to the mounting portion (42; 142) in response to the upwards reaction force, wherein the biasing member extends between the pad and the support.

14. The method of claim 13, further comprising:

detecting an overspeed or over-acceleration of the component (16); and initiating the emergency stop mode by selectively reducing or disconnecting an electrical power supply to the electromagnet (62; 162; 262; 362).

* * * * *